US006065411A

United States Patent [19]

Kuramoto et al.

[11] Patent Number: 6,065,411

[45] Date of Patent: May 23, 2000

[54] STITCH AMPLITUDE ADJUSTING DEVICE FOR SEWING MACHINE

[75] Inventors: Hidechika Kuramoto; Yasuhiro Osanai, both of Tokyo, Japan

[73] Assignee: Janome Sewing Machine Co., Ltd., Tokyo, Japan

[21] Appl. No.: 09/280,568

[22] Filed: Mar. 30, 1999

[51] Int. Cl.[7] ..... D05B 3/02

[52] U.S. Cl. ..... 112/464

[58] Field of Search ..... 112/220, 221, 112/448, 459, 460, 462, 464

[56] References Cited

U.S. PATENT DOCUMENTS

| | | | |
|---|---|---|---|
| 3,130,697 | 4/1964 | Meier | 112/448 |
| 3,238,905 | 3/1966 | Fresard | 112/448 |
| 3,643,612 | 2/1972 | Hanyu et al. | 112/448 |
| 4,052,947 | 10/1977 | Papajewski et al. | 112/464 |

*Primary Examiner*—Ismael Izaguirre
*Attorney, Agent, or Firm*—Lowe Hauptman Gopstein Gilman & Berner

[57] ABSTRACT

An amplitude adjusting device in connection with a sewing machine having an amplitude generating mechanism including a pattern cam and a cam follower which has a central swinging axis around cam follower which is swingable in accordance with the configuration of the pattern cam, wherein the amplitude adjusting device comprises an adjusting lever having a central axis around which the adjusting lever is swingable, the adjusting lever having one end operatively connected to one end of a transmission rod which has the opposite end connected to a swingable needle bar holder. The adjusting lever has the opposite end operatively connected to an operating knob and is normally urged in one direction so that said one end of the transmission rod is normally urged to a position substantially corresponding to the swinging axis of the cam follower. The operating knob is rotated in one direction to swing the adjusting lever in the opposite direction against the urging action applied to the adjusting lever, thereby to move said one end of the transmission rod in the direction away from the position substantially corresponding to the swinging axis of the cam follower. The operating knob is axially pressed and rotated to activate a positioning member to hold the adjusting lever at an optional angular position thereof and accordingly hold said one end of the transmission rod at an optional position away from the swinging axis of the cam follower.

12 Claims, 11 Drawing Sheets

STITCH AMPLITUDE ADJUSTING DEVICE FOR SEWING MACHINE

BACKGROUND OF THE INVENTION

1. Field of the Invention

The present invention relates to a sewing machine and more particularly relates to an amplitude adjusting device of a sewing machine, which is simple in structure and easy in operation which may be optionally switched between one operation mode in which a sewing machine is able to freely vary the width of stitches with manipulation of an operating knob and another operation mode in which the sewing machine user is able to determine an optional constant width of stitches only by setting the operating knob at an optional position thereof.

2. Description of the Prior Art

There have been the sewing machines provided with an amplitude adjusting device wherein an operating knob is normally urged to an initial position where a needle bar holder is set at a null amplitude, that is, not to be laterally reciprocated while a pattern cam is rotated and wherein the operating knob may be rotated in one direction from the initial position against the urging action and may be fixed at an optional angular position thereof to cause the needle bar holder to be laterally reciprocated with a constant amplitude. It is, however, very difficult to hold and maintain the operating knob at an optional fixed position against the urging action. In fact, it requires a considerably complicated mechanism which is difficult and time consuming to assemble and is, therefore, costly.

OBJECTS OF THE INVENTION

The invention has been provided to eliminate the defects and disadvantages of the prior art. It is, therefore, a principal object of the invention to provide a sewing machine having an amplitude adjusting device which is simple as well as reliable in structure and easy in operation and further id realized at a reduced cost.

It is another object of the invention to provide the amplitude adjusting device which enables a sewing machine user to optionally and freely vary the width of the stitches as the stitches are being formed in one operation mode.

It is another object of the invention to provide the amplitude adjusting device which enables enable the sewing machine user to optionally and freely vary the width of the stitches simply by rotating the operating knob against a spring action applied thereto.

It is another object of the invention to provide the amplitude adjusting device which enables enable the sewing machine user to optionally determine a constant width of the stitches in another operation mode.

It is still another object of the invention to provide the amplitude adjusting device which enables the sewing machine user to optionally determine a constant width of the stitches by axially pushing and rotating the operating knob against the spring action.

DETAILED DESCRIPTION OF PREFERRED EMBODIMENTS

The invention will now be described in reference to a preferred embodiment as shown in the attached drawings.

Figure 1:
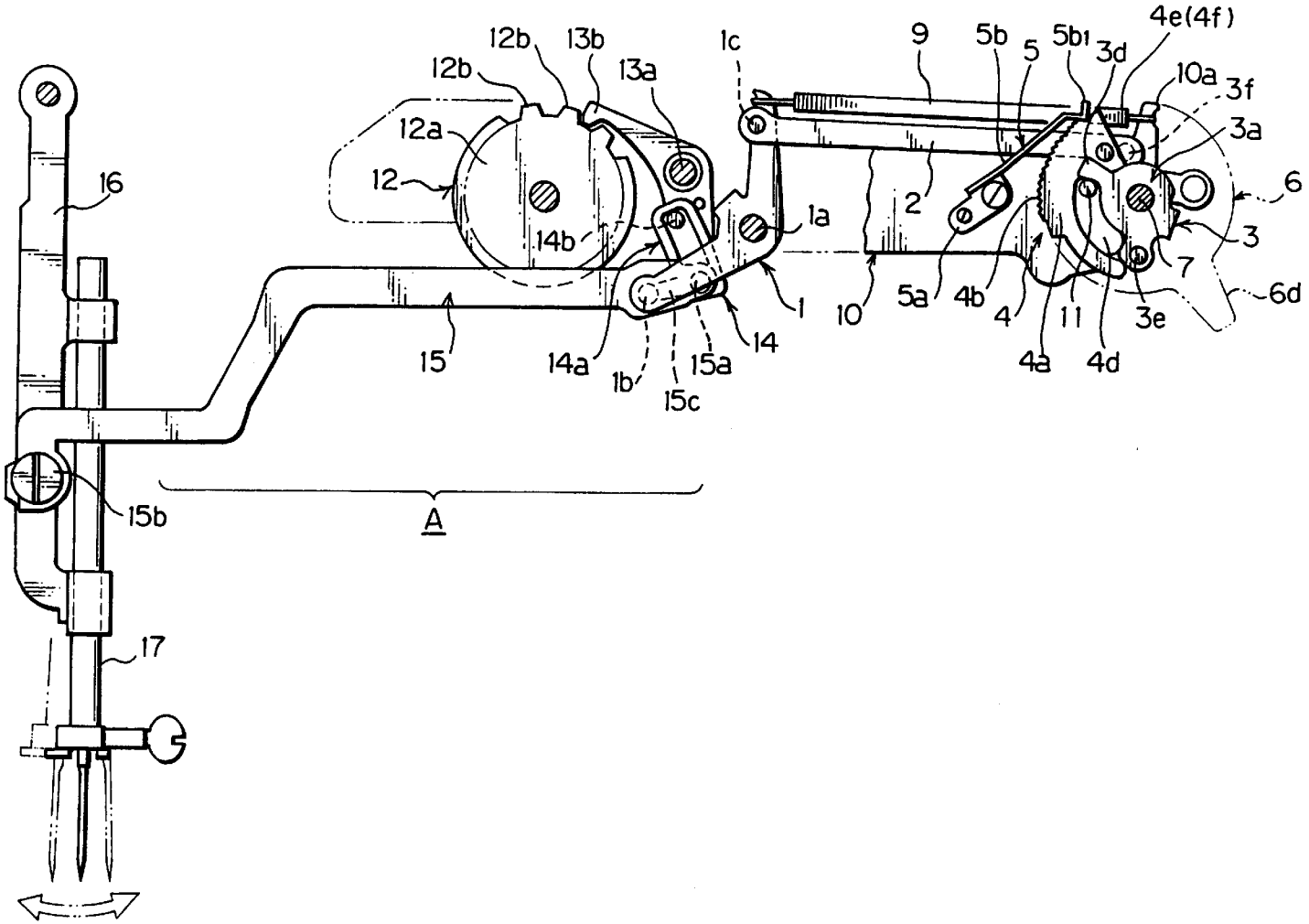
FIG. 1 is a side elevational view of a mechanism of sewing machine according to the invention, which is so set as to laterally reciprocate a needle bar holder.
Figure 2:
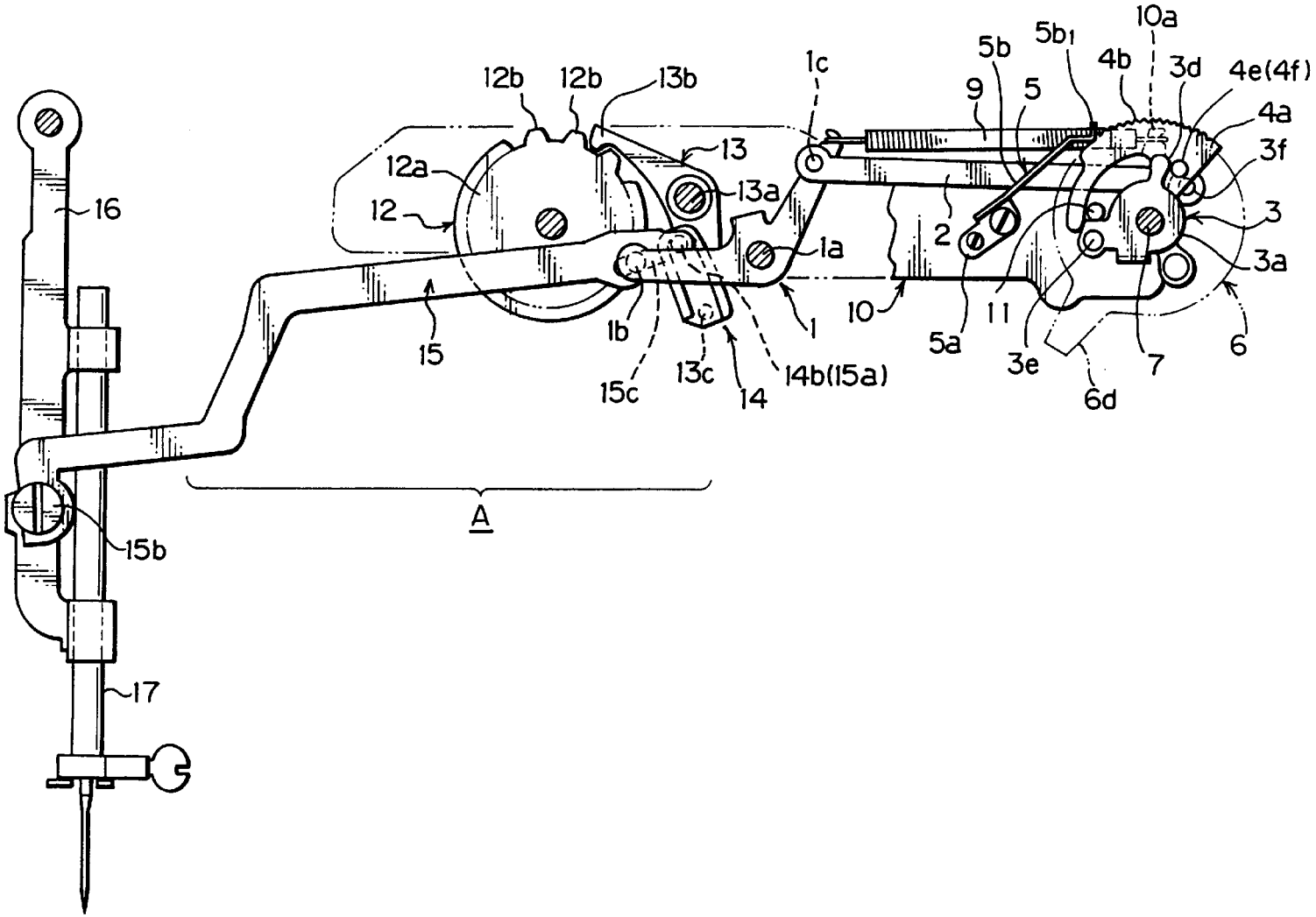
FIG. 2 is a side elevational view of the mechanism of sewing machine which is so set as to hold the needle bar holder at a standstill according to the invention.
Figure 22:
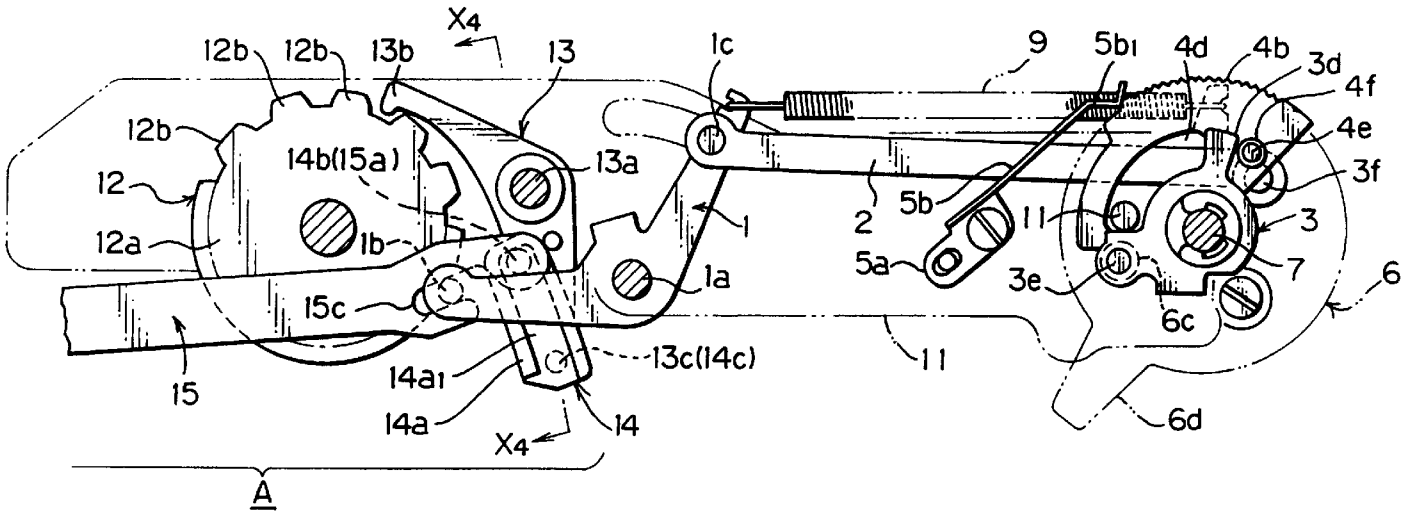
FIG. 22 is an enlarged side elevational view of the embodiment of the invention.

Now in FIGS. 1, 2 and 22, a needle bar 17 having a needle attached to the lower end thereof is supported on a needle bar holder 16 so that the needle bar 17 may be vertically reciprocated.

The needle bar holder 16 is laterally swingable around a support pin fixed to a machine frame (not shown) and supporting the needle bar holder 16 at the top thereof. The needle bar holder 16 is connected to an amplitude generating device A and to an amplitude adjusting lever 1 which is turnably mounted at the center 1*a* thereof on a support plate 10 and is operated to adjust the lateral reciprocation amplitude of the needle bar holder 16. More precisely a transmission rod 15 has one end connected to the needle bar holder 16 by means of a screw 15*b* and has an opposite end part 15*c* connected to one end 1*b* of the amplitude adjusting lever 1.

Figure 3:
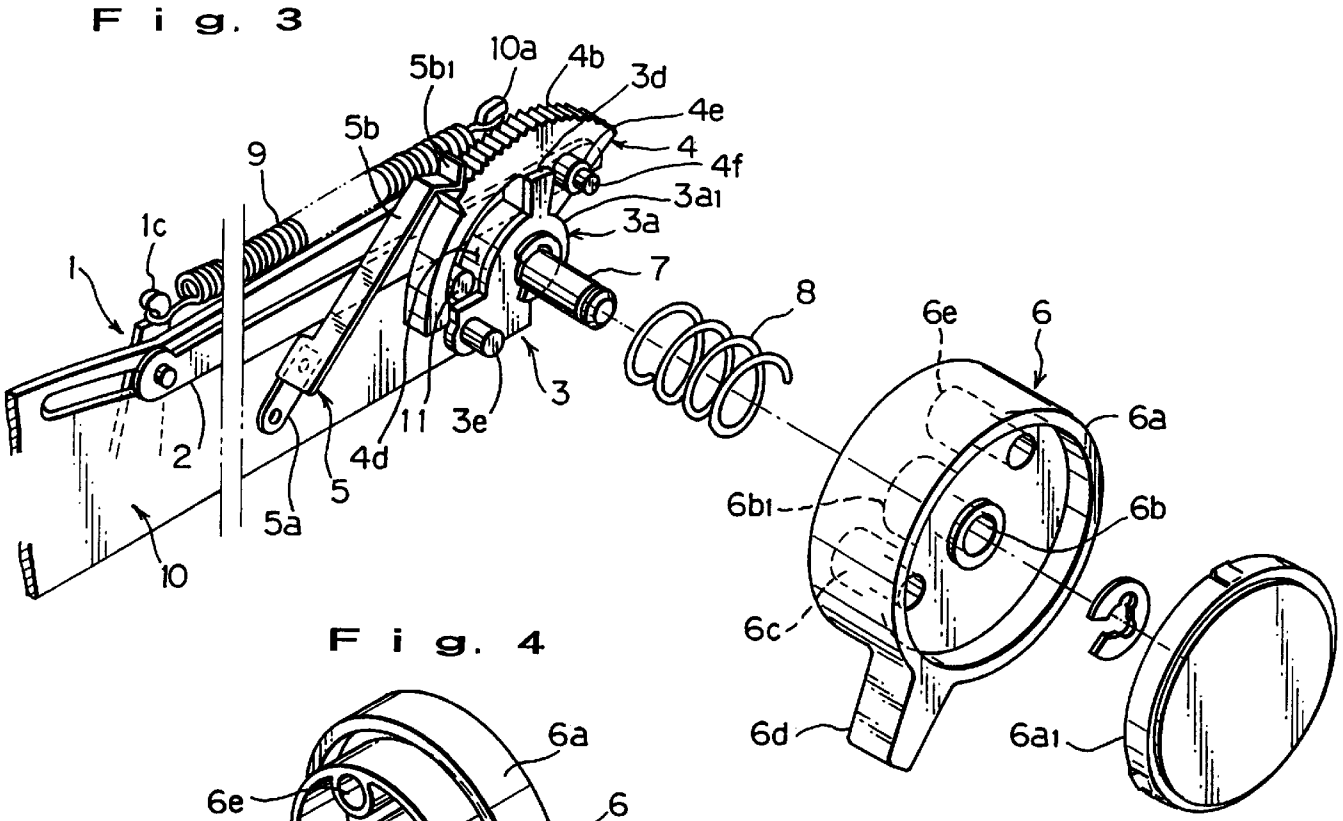
FIG. 3 is a perspective view of an essential part of the invention shown partly as being exploded.
Figure 4:
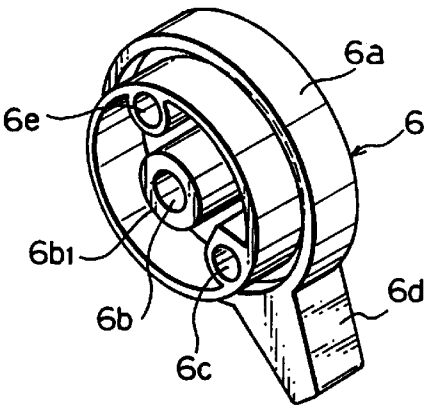
FIG. 4 is a perspective view of an operating knob of the invention showing the inside thereof.

The amplitude adjusting lever 1 has an opposite end part 1*c* connected to one end of an operating rod 2 which has an opposite end operatively connected to a rotational member 3 which is rotatably mounted on a mount shaft 7 laterally extending from the support plate 10 as shown in FIG. 3. The amplitude adjusting lever 1 is normally urged in one rotation direction, that is, in the clockwise direction in this embodiment, by means of a tension spring 9 which has one end connected to an extension of extension of the end part 1*c* and the opposite end connected to a part 10*a* of the support plate 10.

Figure 7:
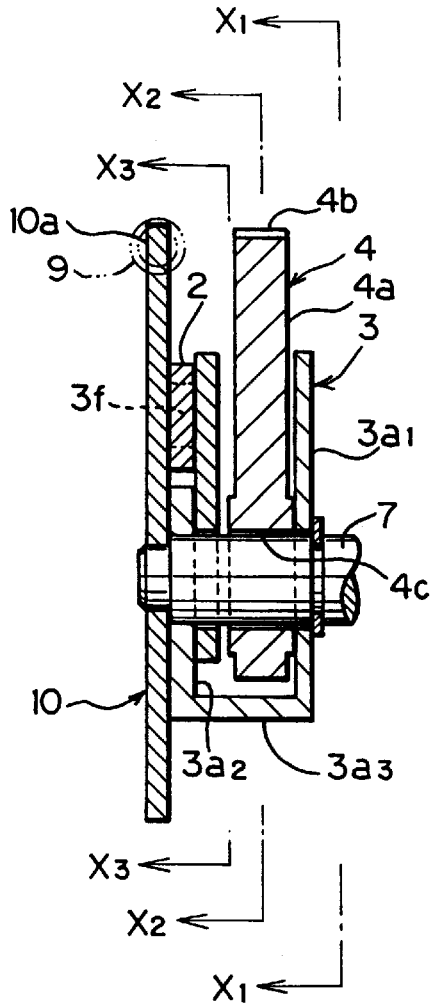
FIG. 7 is a plan elevational view of the essential part of the invention shown in cross section.
Figure 8:
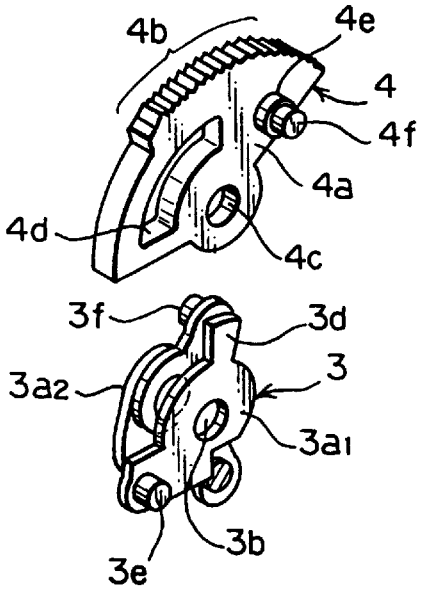
FIG. 8 is a perspective view of essential elements of the invention.
Figure 9:
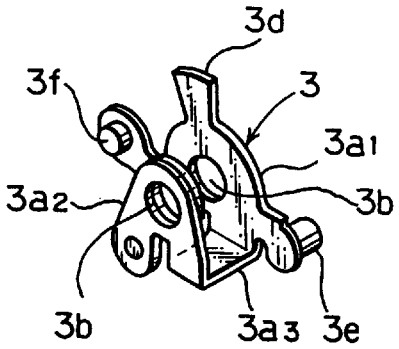
FIG. 9 is another perspective view of one of the essential elements of FIG. 8.

The rotational member 3 is, as particularly shown in FIGS. 8 and 9, composed of a body 3*a*, a front part $3a_1$, a rear part $3a_2$ which is spaced from the front part $3a_1$, but is connected to the latter by means of a connecting part $3a_3$. The front part $3a_1$ and a rear part $3a_2$ have coaxial central holes 3*b* respectively by which the rotational member 3 is rotatably mounted on the shaft 7 as shown in FIG. 7.

The front part $3a_1$ has an upward projection 3*d* formed at the top thereof and has an outer extension angularly spaced from the upward projection 3*d* and having a pin 3*e* axially extending therefrom.

The rear part $3a_2$ has an outer extension having a pin 3*f* axially extending therefrom in the direction opposite to the pin 3*e*. The pin 3*f* is connected to the corresponding end of the operating rod 2 as shown in FIG. 7. Thus the rotational member 3 is operatively connected to the amplitude adjusting lever 1.

The rotational member 3 is operated to adjust the lateral reciprocation amplitude of the needle bar 17 and accordingly of the needle attached to the needle bar 17.

A semicircular positioning member 4 is rotatably mounted at the center hole 4*c* thereof on the mount shaft 7 between the front part $3a_1$ and a rear part $3a_2$ of the rotational member 3. The positioning member 4 has a body 4*a* having serrated teeth 4*b* formed on the outer periphery thereof. The body 4*a* has a pin 4*f* axially extending therefrom as a part of a clutch c which will be described in detail thereinafter. Further the body 4*a* has an elongated arcuate cutout 4*d* provided thereon for determining the rotation extent of the ratchet 4 in cooperation with a pin 11 which is provided on the support plate 10 and inserted into the opening 4*d*.

A pawl member 5 has an elongated shank 5*b* having one end 5*a* fixed to the support plate 10 and having an opposite end formed in a pawl $5b_1$ elastically engaging the serrated teeth of the positioning member 4 to maintain the latter at a set angular position thereof.

An operating knob 6 has a circular body 6*a* having a central bore 6*b* by which the knob 6 is rotatably mounted on the mount shaft 7 coaxially with the rotational member 3 and the positioning member 4 and is axially movable.

The knob 6 has an outwardly directed radial extension 6*d* for the convenience of manual rotation of the knob 6. Further the knob 6 has an inner side having axially extended bores 6*c* and 6*e* radially spaced from the central bore 6*b* and angularly spaced from each other. The bore 6*c* is provided to normally receive the pin 3*e* of the rotational member 3 while the bore 6*e* is provided as a part of the clutch c to be operated in connection with the clutch pin 4*f* of the brake member 4.

Figure 14:
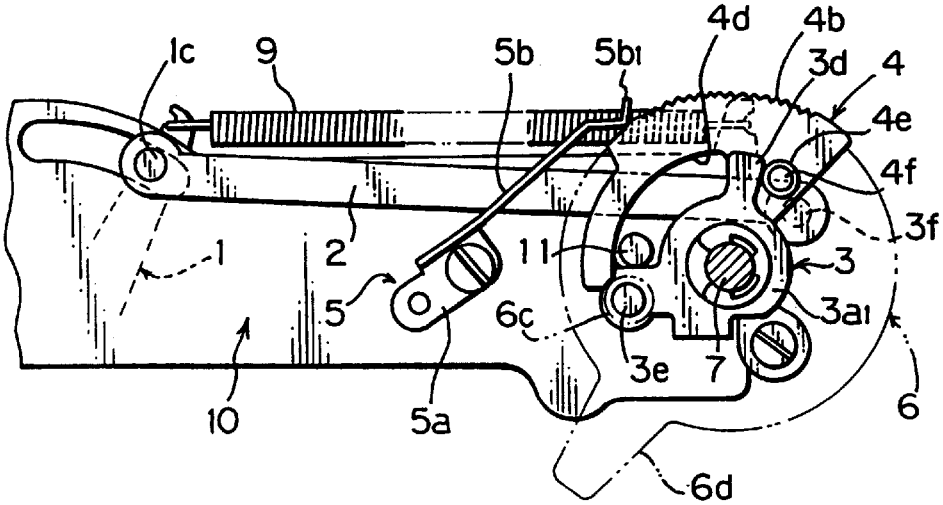
FIG. 14 is a side elevational view of the operating part showing the positional relation of the elements thereof in the operation mode.
Figure 15:
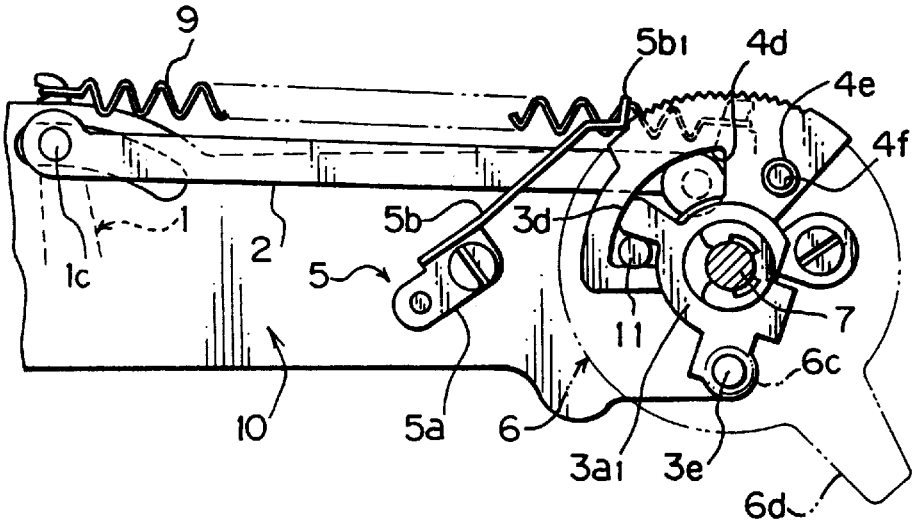
FIG. 15 is a side elevational view of the operating part showing the positional relation of the elements thereof when the operating part is rotated in one direction.
Figure 16:
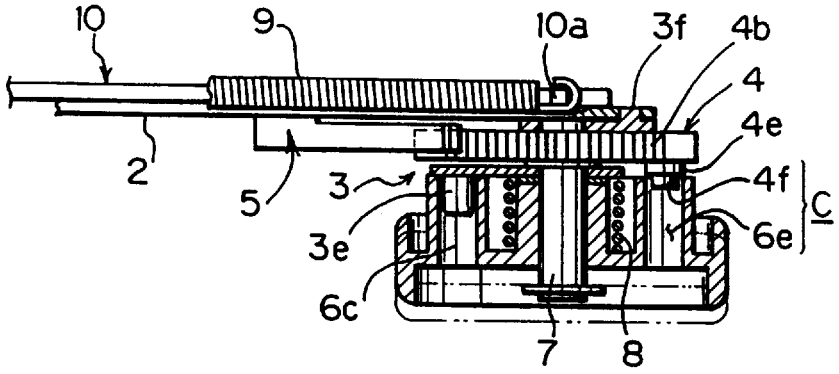
FIG. 16 is a plan elevational view of the operating part of the invention shown in another operation mode partly in cross section.
Figure 17:
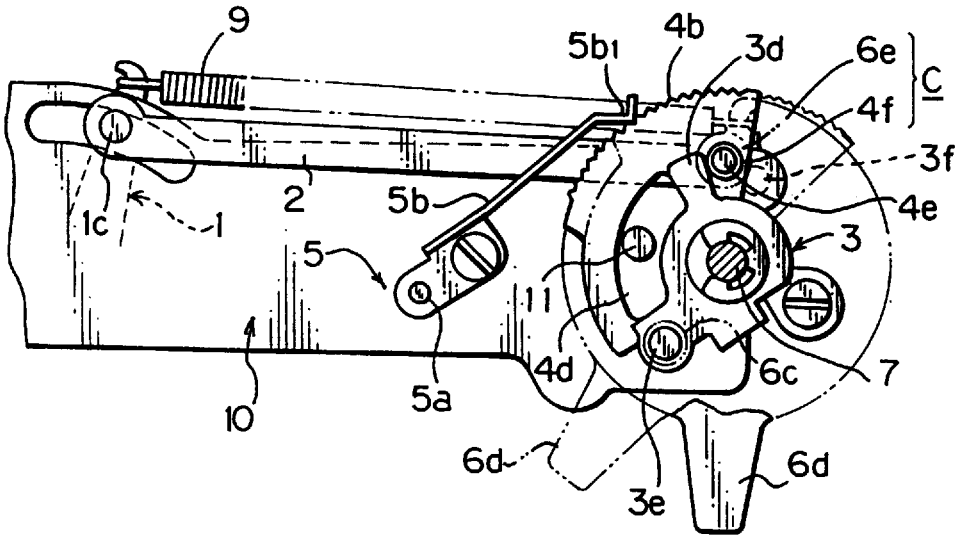
FIG. 17 is a side elevational view of the operating part showing the positional relation of the elements thereof in the operation mode.
Figure 18:
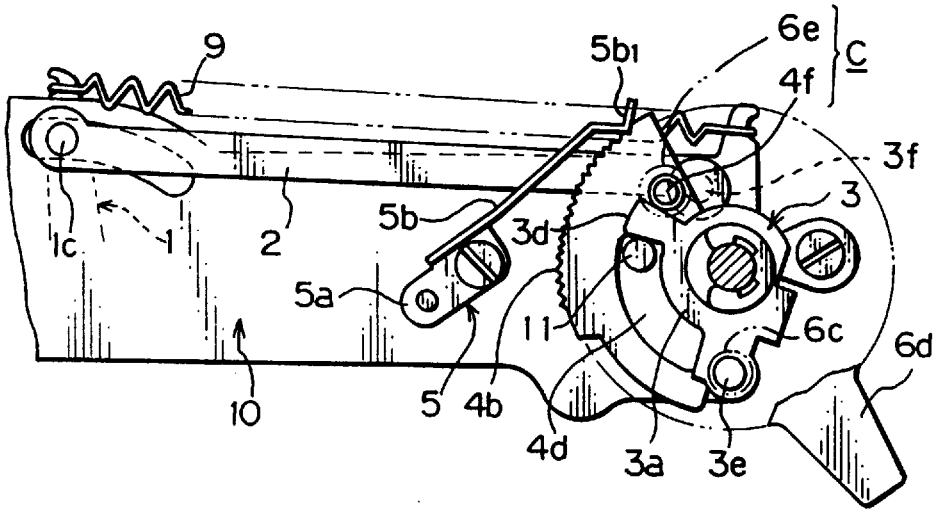
FIG. 18 is a side elevational view of the operating part showing the positional relation of the elements thereof when the operating part is rotated in one direction.
Figure 19:
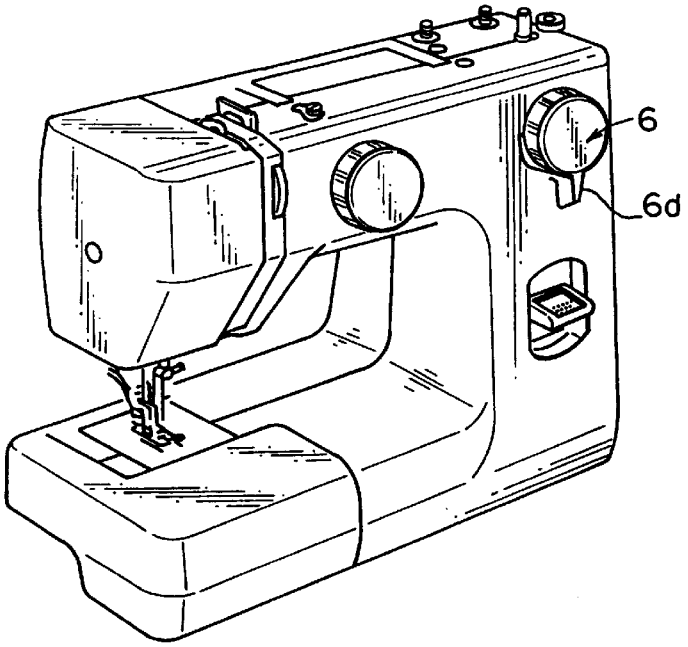
FIG. 19 is a perspective view of a sewing machine having the embodiment of the invention incorporated therein.

Therefore the rotational member 3 may be rotated when the knob 6 is rotated. The positioning member 4 may be rotated together with the rotational member 3 against the spring action of the stopper pawl $5b_1$ when the knob 6 is rotated while the knob 6 is axially pressed against the spring action of a compression spring 8 to cause the clutch bore 6*e* to receive the clutch pin 4*f* as shown in FIG. 16. When the clutch bore 6*e* is axially spaced from the clutch pin 4*f*, the rotation of knob 6 will cause the positioning member 4 to rotate in one direction when the projection 3*d* of the rotational member 3 comes to engage a diametrically enlarged part 4*e* of the clutch pin 4*f* as shown in FIG. 14.

Figure 5:
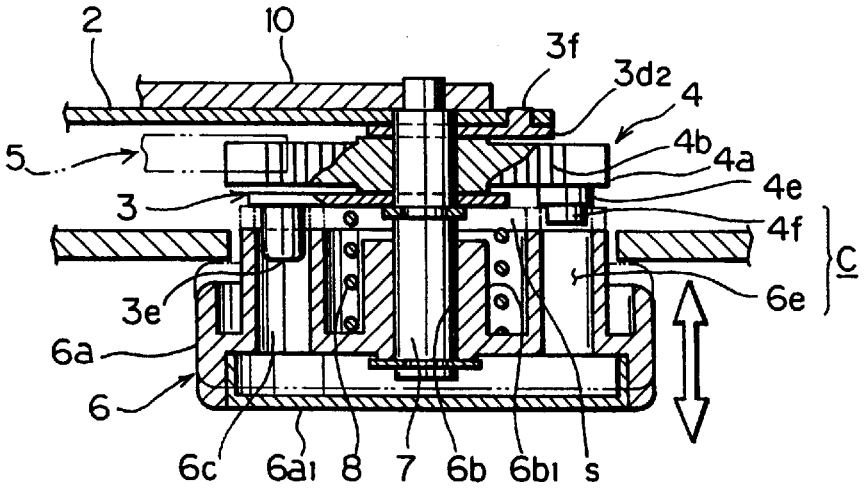
FIG. 5 is a plan elevational view of an operating part of the invention shown in cross section.

The compression spring 8 is provided around a boss $6b_1$ of the axial bore 6*b* and between the knob 6 and the rotational member 3 and normally urges the knob 6 in the direction away from the rotational member 3 and accordingly away from the positioning member 4 as shown in FIG. 5.

Figure 6:
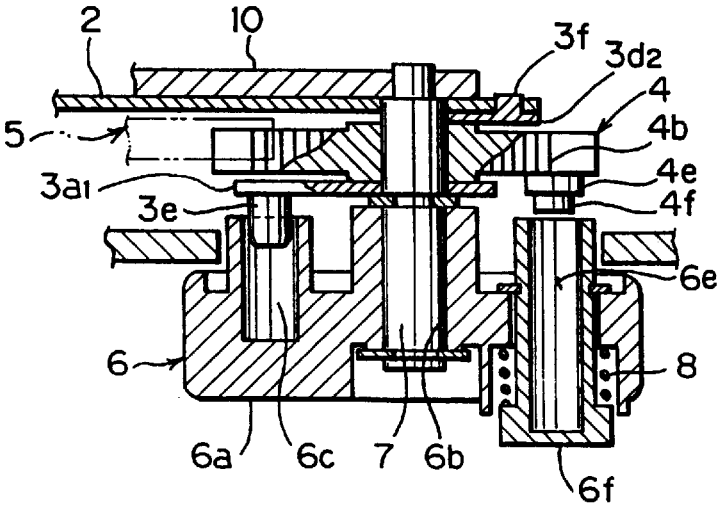
FIG. 6(A) is a plan elevational view of another embodiment of the operating part of the invention shown in cross section and showing one operation mode thereof.
FIG. 6(B) is a plan elevational view of a part of the operating part of FIG. 6(A) shown in cross section and showing another operation mode thereof.
Figure 6:
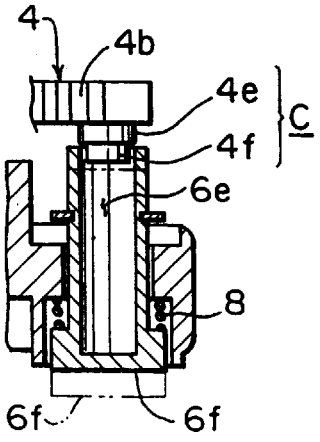

FIG. 6(A) shows another embodiment of the clutch c, wherein a bore member 6*f* having the axial bore 6*e* is axially slidable in the body 6*a* of the knob 6. The bore member 6*f* is normally urged away from the clutch pin 4*f* of the positioning member 4 by means of the compression spring 8 which is provided between the operating knob 6 and the bore member 6*f*. The bore member 6*f*, therefore, may engage the clutch pin 4*f* as shown in FIG. 6(B) when the bore member 6*f* is pressed against the spring action of the compression spring 8.

The knob 6 has a cover $6a_1$ fitted to the front side thereof as shown in FIGS. 3 and 5.

Figure 10:
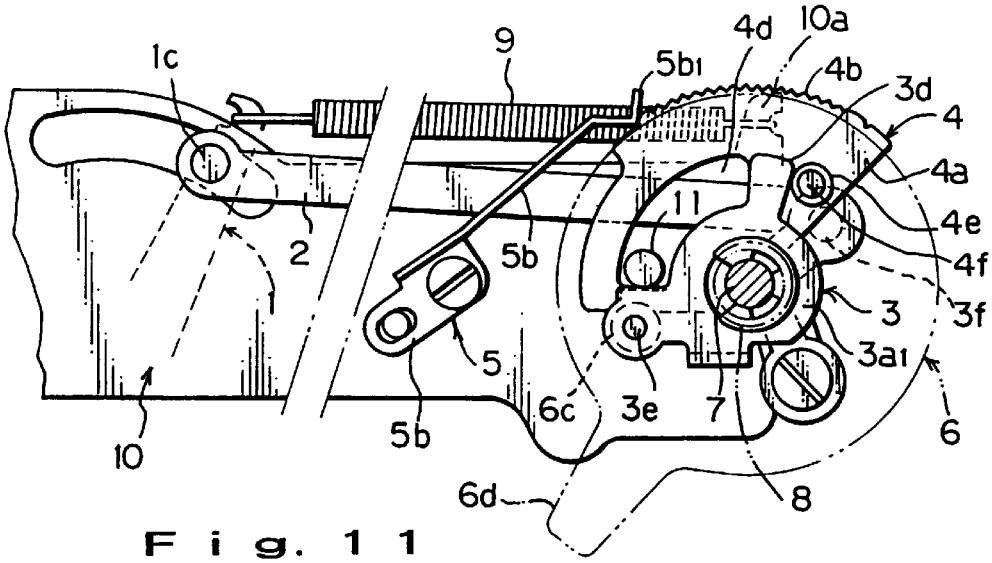
FIG. 10 is a side elevational view taken along the arrow $X_1$—$X_1$ of FIG. 7.
Figure 11:
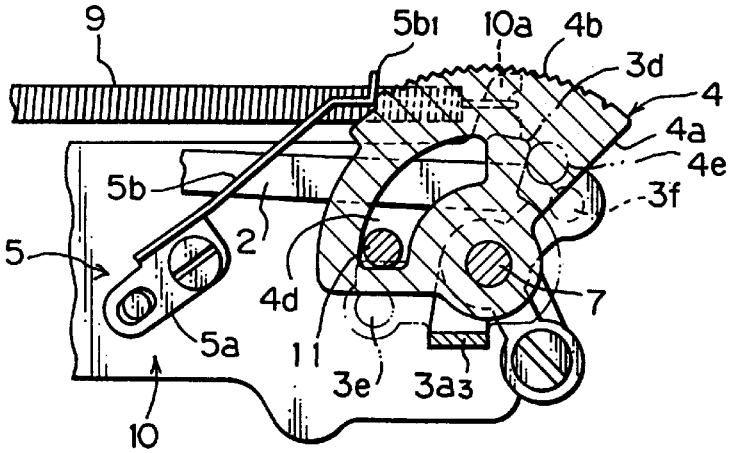
FIG. 11 is a side elevational view taken along the arrow $X_2$—$X_2$ of FIG. 7.
Figure 12:
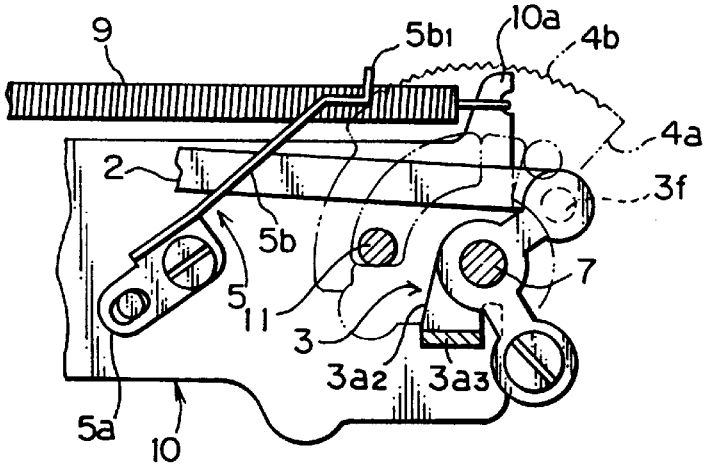
FIG. 12 is a side elevational view taken along the arrow $X_3$—$X_3$ of FIG. 7.
Figure 13:
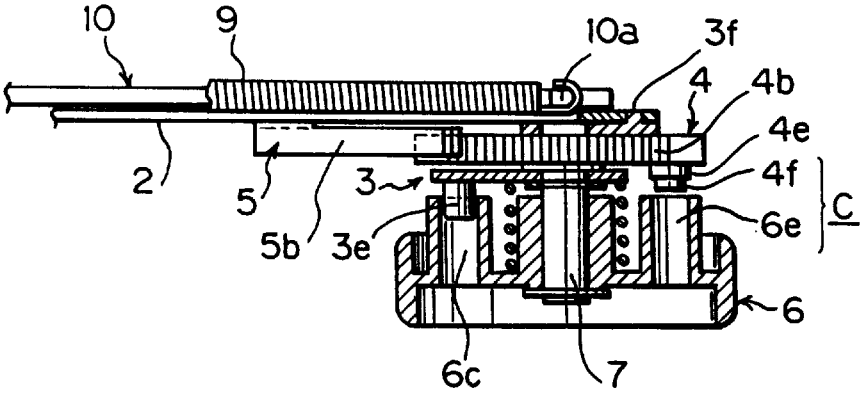
FIG. 13 is a plan elevational view of the operating part of the invention shown in one operation mode partly in cross section.

FIG. 10 is a view taken along the arrows $X_1$—$X_1$. FIG. 11 is a view taken along the arrows $X_2$—$X_2$. FIG. 12 is a view taken along the arrows $X_3$—$X_3$. These Figures show the positional relation between the elements when the brake member 4 is rotated to maximum in one direction, that is, in the clockwise direction.

The amplitude generating device A substantially comprises an amplitude generating disk cam 12, a cam follower 13 and a guide 14.

Figure 25:
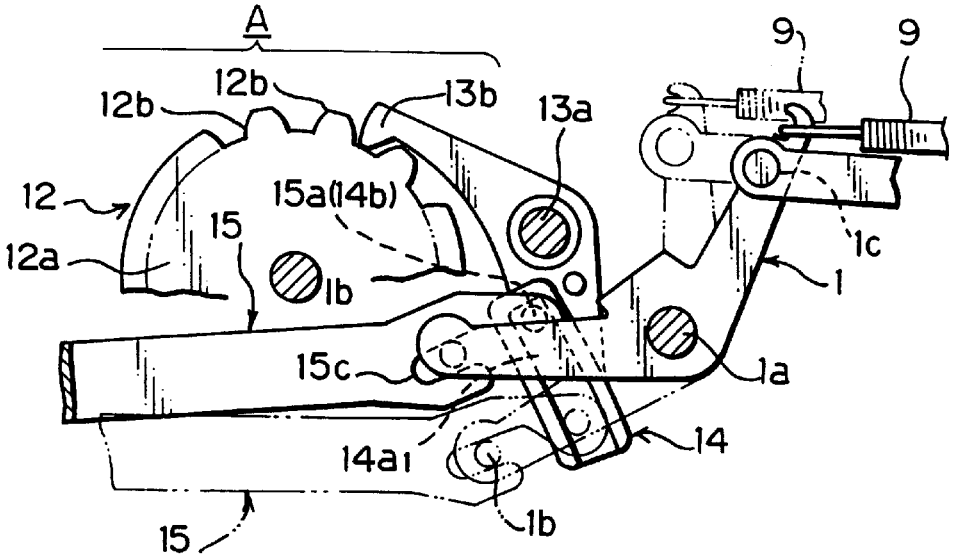
FIG. 25 is a front elevational view of an essential part of the invention shown in one operation mode.
Figure 26:
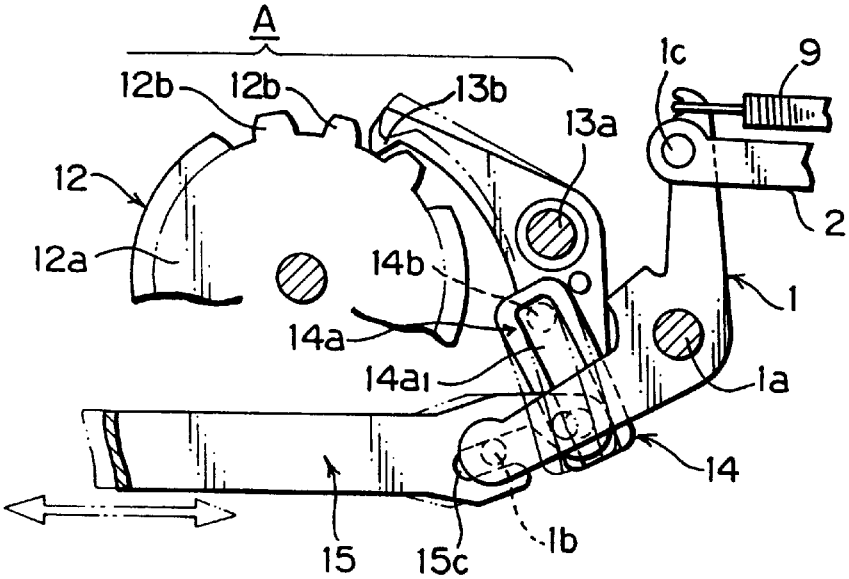
FIG. 26 is a side elevational view of the essential part of the invention shown in another operation mode.

As particularly shown in FIGS. 22, 25 and 26, the cam 12 has a body 12*a* having same projections 12*b* provided on all periphery thereof with an even space provided therebetween, and is rotated in association with the vertical reciprocation of the needle bar 17 which is so moved by the generally known drive mechanism (not shown).

The cam follower 13 has a central axis 13*a* around which the cam follower is swingable, a follower pawl 13*b* formed at the top thereof and is normally urged to engage the peripheral projections 12*b* of the cam 12, and a pin 13*c* connecting the lower end of the cam follower 13 to the lower end of the guide 14.

Figure 24:
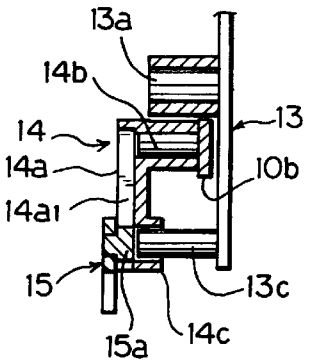
FIG. 24 is a side elevational view taken along the arrow $X_4$—$X_4$ of FIG. 22.
Figure 23:
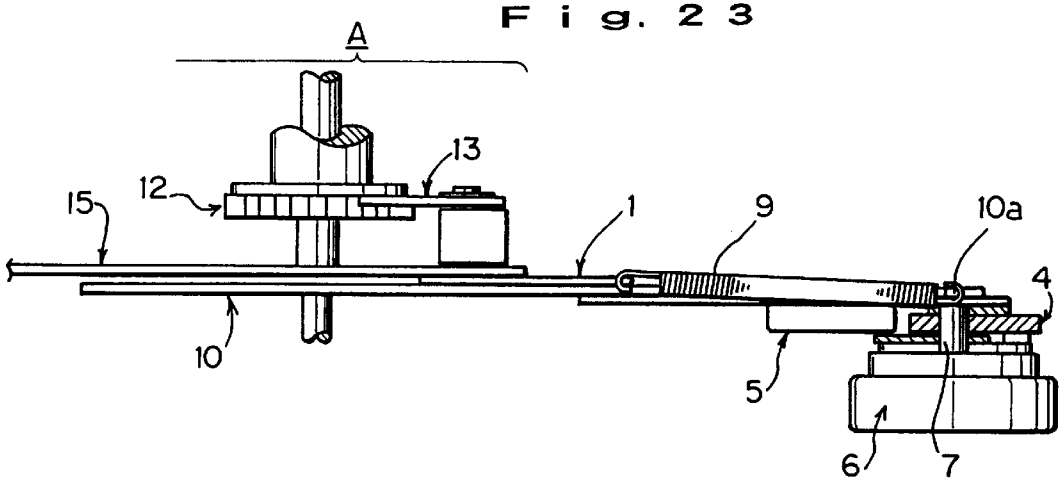
FIG. 23 is a plan elevational view of the embodiment of the invention.

The guide 14 has a body 14*a*, a groove $14a_1$ extending along the body 14*a* and has an axis 14*b* at the top thereof around which the guide is swingable on a part 10*a* of the support plate 10 as shown in FIG. 24.

Therefore when the cam 12 is rotated, the cam follower 13 is swingingly reciprocated around the central axis 13*a* thereof. The swinging reciprocation is transmitted to the guide 14, and the guide 14 is swingingly reciprocated around the top axis 14*b* thereof.

The transmission rod 15 has the end 15*c* having a slide member 15*a* connected thereto. The slide member 15*a* is placed in engagement with the groove $14a_1$ of the guide 14 and is slidable in the groove between the upper swing center 14*b* and the lower end 13*c* thereof.

As shown in FIG. 2, when the slide member 15*a* is positioned at the upper swing axis 14*b* of the guide 14, the swinging movement of the guide 14 is not transmitted to the needle bar holder 16 through the transmission rod 45. However as the slide member 15*a* is moved from the upper swing axis 14*b* of the guide 14 to the lower end of the guide 14, the swinging movement of the guide 14 is transmitted to the needle holder 16 progressively from minimum to maximum.

The slide member 15*a* is moved from the upper swing axis of 14*b* to the lower end of the guide 14 and vice versa by the amplitude adjusting lever 1 which is rotatingly moved around the center 1*a* thereof.

The rotational movement of the amplitude adjusting lever 1 may be controlled from the operating knob 6 through the rotational member 3 and the operating rod 2 which rotatingly moves the amplitude adjusting lever 1 in one or the opposite direction and then the amplitude adjusting lever 1 rotatingly moves the transmission rod 15 around the screw 15*b* located at the needle holder 16.

In this embodiment, the operating knob 6 is normally urged to an initial angular position by the spring action of the tension spring 9 as shown in FIGS. 2 and 10, wherein the slide member 15*a* is located at the rotation axis 4*b* of the guide 4 while the positioning member 4 is maintained at an initial position by the rotational member 3 which has the projection 3*d* engaging the diametrically enlarged base 4*e* of the clutch pin 4*f* of the positioning member 4 as shown in FIGS. 2 and 10.

Figure 21:
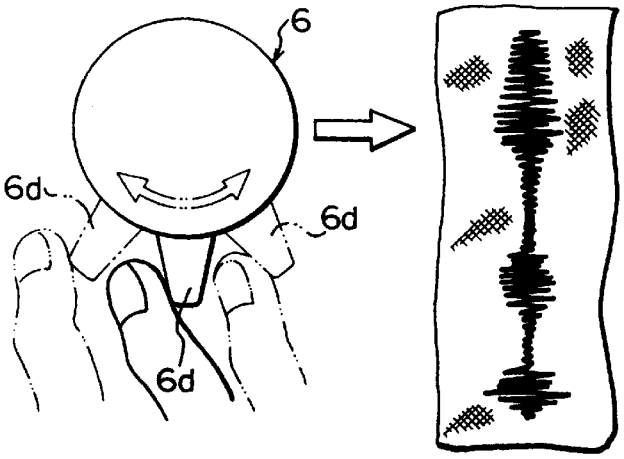
FIG. 21 is a plan elevational view of the stitches to be formed in another mode of the invention, shown in connection with the operating part.

According to the invention, the amplitude of the needle may be optionally varied to freely change the width of zigzag stitches as shown in FIG. 21.

In this case, the operating knob 6 is simply rotated without being axially pressed. In this embodiment, if the operating knob 6 is rotated in the counterclockwise direction from the initial angular position, the rotational member 3 is rotated in the same direction and the operating rod 2 is moved in the leftward direction. The amplitude adjusting lever 1 is, therefore, rotated in the counterclockwise direction against the spring action of the tension spring 9. As the result, the slide member 15*a* is slidingly moved in the groove $14a_1$ of the guide 14 in the direction away from the rotation axis 14*b* of the guide 14.

On the contrary, if the operating knob 6 is gradually released, the operating knob 6 is gradually rotated back to the initial angular position by the spring action of the tension spring 9. Simultaneously the operating rod 2 is gradually moved in the rightward direction. The amplitude adjusting lever 1 is, therefore, gradually rotated in the clockwise direction As the result, the slide member 15*a* is slidingly moved in the groove $14a_1$ of the guide 14 in the direction toward the rotation axis 14*b* of the guide 14.

It is therefore apparent that if the operating knob 6 is rotated more in the counterclockwise direction, the larger is the amplitude of the needle and accordingly the larger is the width of the zigzag stitches from minimum to maximum.

On the contrary, if the operating knob 6 is gradually released from the angular position at which the operating knob 6 has been rotated most in the counterclockwise direction, the smaller is the amplitude of the needle and accordingly the smaller is the width of the zigzag stitches from maximum to minimum.

Figure 20:
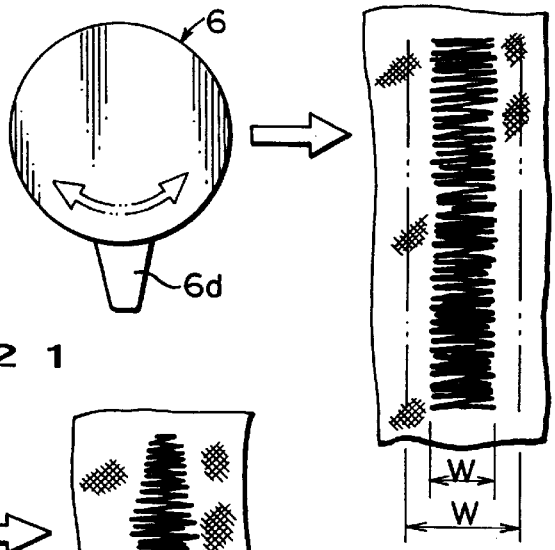
FIG. 20 is a plan elevational view of the stitches to be formed in one operation mode of the invention, shown in connection with the operating part.

Further according to the invention, it is possible to form the zigzag stitches of constant width which may be optional as shown in FIG. 20.

In this case, the operating knob 6 is pressed against the spring action of the compression spring 8 when it is located at the initial angular position, thus to connect the operating knob 6 to the positioning member 4 by the clutch c, and is subsequently rotated in the counterclockwise direction in this embodiment.

The positioning member 4 is, therefore, rotated in the same direction against the spring action of the stopper pawl $5b_1$ together with the operating knob 6 and accordingly with the rotational member 3.

In the meantime, if the operating knob 6 is released at any optional angular position, the operating knob 6 is held at the angular position without being rotated back to the initial angular position and without being pressed back by the repelling spring action of the compression spring 8 because the positioning member 4 is held at the angular position by the stopper paw $15b_1$ giving a spring action to the serrated teeth 4*b* of the positioning member 4, the spring action being stronger than that of the tension spring 9.

Thus the slide member 15*a* may be held at any optional position along the guide groove $14a_1$ of the guide 14. As the result, the swinging movement of the guide 14 transmitted to the needle bar holder 16, that is, to the needle through the transmission rod 15 is constant. Therefore the amplitude of the needle is constant, and the zigzag stitches of a constant width W may be obtained between minimum and maximum.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An amplitude adjusting device of a sewing machine having a main shaft rotated to vertically reciprocate a needle bar having a needle attached to the lower end thereof and being supported on a laterally swingable needle bar holder and an amplitude generating mechanism including a pattern cam rotated in association with rotation of the main shaft and a cam follower having a central axis thereof around which the cam follower is swingable, the cam follower having one end engaging the pattern cam and the opposite end operatively connected to the swingable needle bar holder and being swingable in accordance with the configuration of the pattern cam, said amplitude adjusting device comprising:

adjusting means normally activated to hold said swingable needle bar holder at a standstill while said cam follower is swingingly moved;

operating means operatively connected to said adjusting means and manipulated in one direction to operate said adjusting means, thereby to enable said swingable needle bar holder to swingingly move in accordance with the swinging movement of said cam follower; and positioning means operatively connected to said operating means when the latter is manipulated in another direction, said positioning means activated in association with said manipulation in said one direction of said operating means to hold said swingable needle bar holder at a constant swinging amplitude in accordance with the swinging movement of said cam follower.

2. An amplitude adjusting device of a sewing machine having a main shaft rotated to vertically reciprocate a needle bar having a needle attached to the lower end thereof and being supported on a laterally swingable needle bar holder and an amplitude generating mechanism including a pattern cam rotated in association with rotation of the main shaft, a cam follower having one end engaging the pattern cam and being swingable around a central axis thereof in accordance with the configuration of the pattern cam and having the opposite end operatively connected to one end of a transmission rod which has the opposite end connected to the laterally swingable needle bar holder to transmit the swinging movement of the cam follower to the laterally swingable needle bar holder, said amplitude adjusting device comprising:

adjusting means for normally urging said one end of said transmission rod to a position substantially corresponding to said swinging axis of said cam follower;

operating means operatively connected to said adjusting means and manually rotated in one direction to operate said adjusting means, thereby to move said one end of said transmission rod in a direction away from said position substantially corresponding to said swinging axis of said cam follower; and positioning means connected to said operating means when the latter is pressed, said positioning means activated in association with the rotational operation in one direction of said operating means to hold said one end of said transmission rod at an optional position away from said swinging axis of said cam follower.

3. The amplitude adjusting device as defined in claim 2, wherein said adjusting means includes an adjusting lever having a central axis around which said adjusting lever is swingable and is normally urged in one direction, said adjusting lever having one end connected to said one end of said transmission rod and normally urging said one end of said transmission rod to said position substantially corresponding to said swinging axis of said cam follower; wherein said operating means includes an operating knob axially movable and normally operatively connected to an end of said adjusting lever opposite to said one end of said adjusting lever which is operatively connected to said one end of said transmission rod, said operating knob being rotated in one direction to swing said adjusting lever in a direction opposite to the direction in which said adjusting lever is urged, thereby to move said one end of said transmission rod in said direction away from said swinging axis of said cam follower; and wherein said positioning means includes a serrated member which is rotatably supported and operatively connected to said adjusting lever when said operating knob is axially pressed, said serrated member being rotated with said operating knob, said positioning means further including a stopper normally engaging said serrated member with a spring action and being elastically yieldable to allow the rotation of said serrated member and holding said serrated member at an optional angular position thereof.

4. The amplitude adjusting device as defined in claim 3, wherein said serrated member is arranged coaxially with said operating knob and has an elongated arcuate cutout provided thereon, said cutout cooperating with a fixed stopper pin to determine the rotation extent of said serrated member.

5. The amplitude adjusting device as defined in claim 3, wherein said adjusting means further includes a guide member arranged between said cam follower and said one end of said transmission rod, said guide member having a guide groove formed thereon and having one end having an axis around which said guide member is swingable and having the opposite end connected to said opposite end of said cam follower, and a slide member connected to said one end of said transmission rod and placed in engagement with said guide groove of said guide member.

6. The amplitude adjusting device as defined in claim 3, wherein said adjusting lever is normally urged in said one direction by means of a tension spring.

7. The amplitude adjusting device as defined in claim 3, wherein said stopper has an elongated shank having a stopper pawl formed thereon for elastically engage said serrated member, said stopper having a spring force stronger than that of said tension spring.

8. The amplitude adjusting device as defined in claim 3, wherein said operating means further includes a rotational member arranged between said operating knob and said adjusting lever and connected to said lever by means of an operating rod, said rotational member being rotated with said operating knob to swing said adjusting lever in a direction opposite to said one direction in which said lever is normally urged by means of said tension spring, thereby to move said slide member in said direction away from said swinging axis of said guide member.

9. The amplitude adjusting device as defined in claim 8, wherein said operating means further includes a compression spring arranged between said rotational member and said operating knob and normally urging said operating knob axially in a direction away from said serrated member.

10. The amplitude adjusting device as defined in claim 8, wherein said operating knob has an outwardly and radially extended projection for the convenience of rotational operation of said operating knob.

11. The amplitude adjusting device as defined in claim 3, wherein said operating means further includes a clutch arranged between said operating knob and said serrated member, said clutch being activated to connect said operating knob to said serrated member when said operating knob is axially pressed.

12. The amplitude adjusting device as defined in claim 11, wherein said clutch includes a clutch pin provided on said serrated member and axially extended and a clutch bore provided on said operating knob and axially extended to receive therein when said operating knob is axially pressed.

* * * * *